US007909562B2

(12) United States Patent
Mead

(10) Patent No.: US 7,909,562 B2
(45) Date of Patent: Mar. 22, 2011

(54) MATERIAL HANDLING APPARATUS

(75) Inventor: Dennis Mead, Swanzey, NH (US)

(73) Assignee: C&S Wholesale Grocers, Inc., Keene, NH (US)

( * ) Notice: Subject to any disclaimer, the term of this patent is extended or adjusted under 35 U.S.C. 154(b) by 507 days.

(21) Appl. No.: 11/834,804

(22) Filed: Aug. 7, 2007

(65) Prior Publication Data

US 2008/0044270 A1 Feb. 21, 2008

Related U.S. Application Data

(60) Provisional application No. 60/821,786, filed on Aug. 8, 2006.

(51) Int. Cl.
*B66F 9/19* (2006.01)

(52) U.S. Cl. ..... 414/661

(58) Field of Classification Search ..... 414/661
See application file for complete search history.

(56) References Cited

U.S. PATENT DOCUMENTS

| | | | | | |
|---|---|---|---|---|---|
| 2,619,241 | A | * | 11/1952 | Jessen | 414/661 |
| 2,832,487 | A | * | 4/1958 | Oster et al. | 414/661 |
| 2,867,341 | A | * | 1/1959 | Tieslau | 414/633 |
| 3,885,692 | A | * | 5/1975 | Anderson, Jr. | 414/660 |
| 4,217,074 | A | | 8/1980 | Leasor et al. | 414/642 |
| 4,482,286 | A | | 11/1984 | Farmer et al. | 414/607 |
| 4,526,504 | A | * | 7/1985 | Hovey | 414/661 |
| 5,577,873 | A | * | 11/1996 | Tanaka et al. | 414/400 |
| 5,769,595 | A | | 6/1998 | Pearce et al. | 414/661 |
| 6,129,502 | A | * | 10/2000 | Marcelli | 414/661 |

FOREIGN PATENT DOCUMENTS

| | | | | |
|---|---|---|---|---|
| JP | 5-330799 | * | 12/1993 | 414/661 |

* cited by examiner

*Primary Examiner* — James Keenan
(74) *Attorney, Agent, or Firm* — Mintz, Levin, Cohn, Ferris, Glovsky and Popeo, P.C.

(57) ABSTRACT

A material handling apparatus for use with a material carrier board including an aperture, the material handling apparatus being configured to couple to a lifting portion of a lift truck that includes forks, the material handling apparatus including a mount configured to be coupled to the lifting portion of the lift truck, a backrest having a bottom edge and a front face, a scissor structure coupled to the mount and to the backrest, the scissor structure being configured to operate between extended and retracted states, wherein when the scissor structure is operated from the retracted state to the extended state, the backrest is extended from a proximal end of the forks towards a distal end of the forks, the stop plate being attached to the backrest such that the horizontal planar portion is substantially perpendicular to the front face of the backrest, the vertical planar portion is substantially parallel to and offset from the front face of the backrest, the horizontal planar portion of the stop plate forming an aperture, a first actuator coupled to the mount and the scissor structure being configured to actuate the scissor structure between the extended and retracted states, a second actuator coupled to the backrest, a stud and configured to operate between extended and retracted states, the stud being configured to extend through the aperture formed in the carrier board when the stud is actuated from the retracted to the extended state, wherein the material handling apparatus is configured to pull the carrier board onto the forks by, when the stud is in the extended state, actuating the scissor portion from an extended state to a retracted state.

7 Claims, 8 Drawing Sheets

MATERIAL HANDLING APPARATUS

CROSS-REFERENCE TO RELATED ACTIONS

This application claims the benefit of U.S. Provisional Application No. 60/821,786 filed Aug. 8, 2006, which is incorporated by reference herein in its entirety.

BACKGROUND

Today, many forms of goods are transported through the supply chain from manufacturers and growers to distributors and retailers. The manufacturers and suppliers typically use material handling devices, such as pallets and slip sheets, to move the products through the supply chain. Material handling devices are typically moved about using material handling vehicles, such as forklifts, pallet jacks, orderpickers, robots, etc. The material handling vehicles typically place the material handling devices, along with the product, into a conventional warehouse racking system. Employees and/or consumers can retrieve the products from the racking system.

SUMMARY

In general, in an aspect, the invention provides a material handling apparatus for use with a material carrier board including an aperture, the material handling apparatus being configured to couple to a lifting portion of a lift truck that includes forks, the material handling apparatus including a mount configured to be coupled to the lifting portion of the lift truck, a backrest having a bottom edge and a front face, a scissor structure coupled to the mount and to the backrest, the scissor structure being configured to operate between extended and retracted states, wherein when the scissor structure is operated from the retracted state to the extended state, the backrest is extended from a proximal end of the forks towards a distal end of the forks, a stop plate including horizontal and vertical planar portions, the stop plate being attached to the bottom edge of the backrest, the stop plate being attached to the backrest such that the horizontal planar portion is substantially perpendicular to the front face of the backrest, the vertical planar portion is substantially parallel to and offset from the front face of the backrest, the horizontal planar portion of the stop plate forming an aperture, a first actuator coupled to the mount and the scissor structure being configured to actuate the scissor structure between the extended and retracted states, a second actuator coupled to the backrest, a stud coupled to the second actuator and configured to operate between extended and retracted states along an axis that is substantially parallel to the front face of the backrest, the stud being configured to extend through the aperture formed in the stop plate and through the aperture formed in the carrier board when the stud is actuated from the retracted to the extended state, wherein the material handling apparatus is configured to pull the carrier board onto the forks by, when the stud is in the extended state, actuating the scissor portion from an extended state to a retracted state.

Embodiments of the invention may provide one or more of the following features. The horizontal and vertical planar portions are configured in an L-shape. The stud includes a tapered portion that is positioned on a distal end of the stud, wherein the tapered portion is configured to aid alignment of the stud and the aperture in the carrier board. The actuation of the scissor portion is controlled by a three-way control. The actuation of the stud is controlled by a three-way control. The actuation of the scissor portion and the stud are controlled by a single three-way control. The apparatus further includes a plurality of guide blocks coupled to the stop and configured to align the stud with the aperture formed in the horizontal portion of the stop.

In general, in another aspect, the invention provides a method for handling a load disposed on a carrier board using a lift truck including a lifting portion that includes forks, the method including approaching the carrier board at a first location with the lift truck, positioning the lifting portion to a height such that a top surface of the forks is lower than a bottom of the carrier board, extending a backrest portion towards a distal end of the forks, the backrest portion including a stud configured to be received by an aperture in the carrier board, actuating the stud such that the stud extends at least partially through the aperture in the carrier board, retracting the backrest portion towards a proximal end of the forks such that the carrier board is pulled onto the forks by the stud, wherein the carrier board is supported by the forks, relocating the carrier board to a second location, positioning the lifting portion such that the top surface of the forks is at least as high as a surface of interest onto which the carrier board will be placed, and extending the backrest portion towards the distal ends of the forks such that a stop portion of the backrest pushes the carrier board onto the surface of interest.

Embodiments of the invention may also provide one or more of the following features. The method further includes retracting the stud from the aperture. Extending the backrest portion towards the distal ends of the forks such that a stop portion of the backrest drives the carrier board onto the surface of interest includes driving the carrier board into a racking system. The method further includes controlling the operation of the lift truck using hand operator controls. The method further includes controlling the operation of the lift truck using an automated controller. The method further includes controlling the operation of the backrest using a three-way control. The method further includes controlling the operation of the stud using a three-way control. The method further includes controlling the operation of the backrest and the stud using a single three-way control.

Various aspects of the invention may provide one or more of the following capabilities. A load of material can be handled without an ordinary pallet. Individual tiers of material can be handled using carrier boards. Load handling efficiency can be increased. A push-pull assembly can be used to handle a load of material disposed on a carrier board. Ordinary pallets and carrier boards can be handled by a single lift truck.

These and other capabilities of the invention, along with the invention itself, will be more fully understood after a review of the following figures, detailed description, and claims.

DETAILED DESCRIPTION

Figure 1:
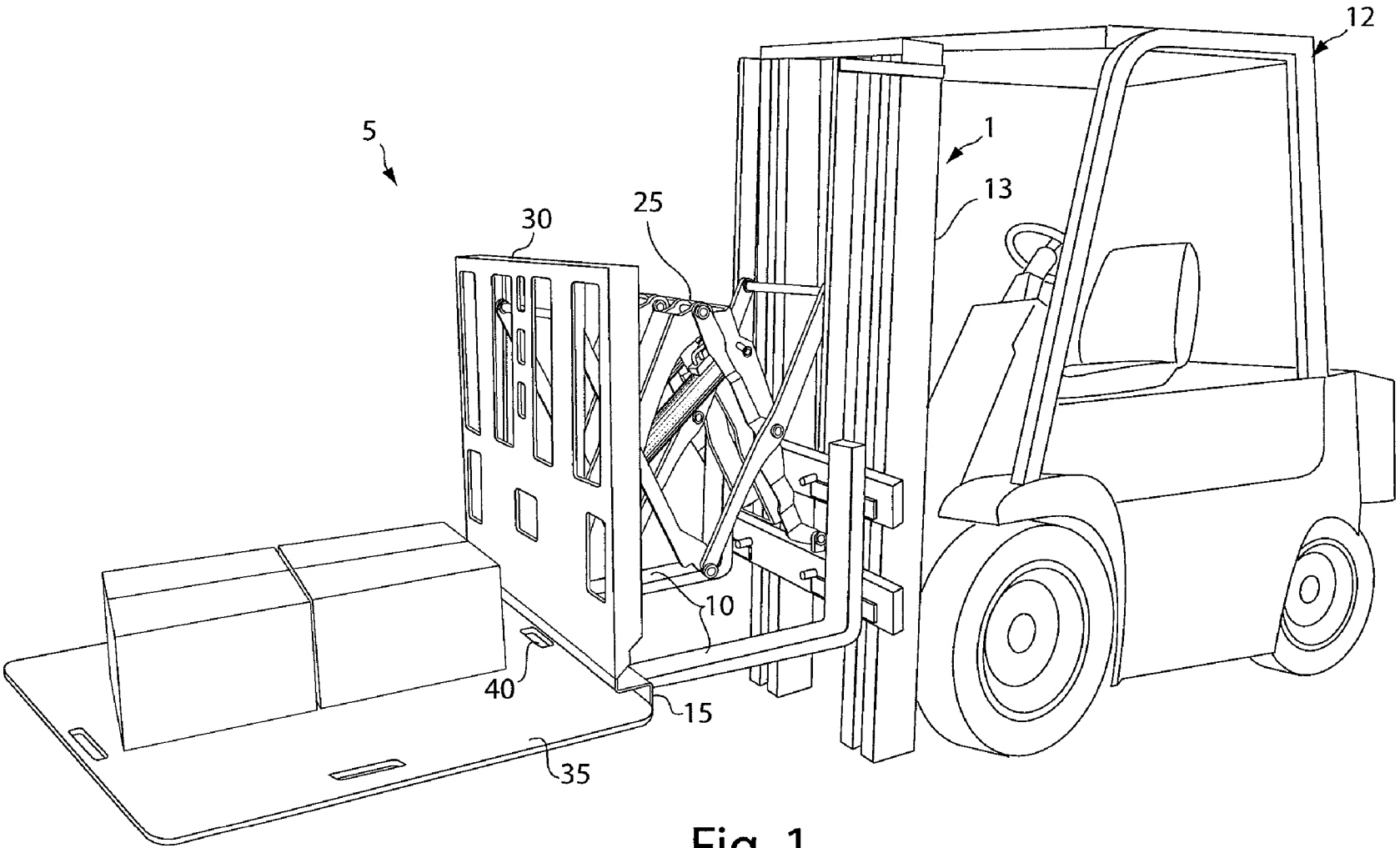
FIG. 1 is a diagram of a portion of a material handling apparatus.

Embodiments of the invention provide techniques for providing an apparatus that is configured to handle material carrier boards used in material handling systems. The apparatus is an attachment that is configured to be used with a standard forklift truck or automated material handling system. The handling apparatus is further configured to be used with a carrier board that includes gripping apertures. The handling apparatus includes a backrest portion, an actuating portion, and a scissor portion. The actuating portion includes a stud that that is configured to be actuated in first and second positions such that in the second position the stud extends through the gripping aperture in the carrier board. The scissor portion can be actuated to extended and retracted positions such that when the stud is extended, and the scissor portion is actuated from the extended position to the retracted position, the stud is configured to pull the carrier board onto the forks of the forklift. Other embodiments are within the scope of the invention.

Referring to FIGS. 1-8, a carrier board handling system 1 includes an extendable push-pull assembly 5, forks 10, and a lift truck 12. The lift truck 12 is, for example, a forklift, a slipsheet machine, an order picker, a tractor, or a reach truck. The lift truck 12 includes a lifting portion 13. The lifting portion 13 extends vertically and is configured to lift the forks 10 and the push-pull assembly 5 to a desired height (e.g., the height of a bay in a racking system). The push-pull assembly 5 is configured to attach to the lift truck 12 either removably or permanently. For example, the push-pull assembly 5 can be attached to the lift truck 12 using hooks, fasteners (e.g., bolts), can be welded to the lift truck 12, or can be coupled to the lift truck 12 using a "quick connect" system. The push-pull assembly 5 is configured to be actuated in outward and inward directions (relative to the front of the lift truck 12), although other directions are possible. For example, the push-pull assembly 5 is extended away from the front of the lift truck 12 towards a distal end of the forks 10 by actuating the push-pull assembly 5 in the outward direction. The push-pull assembly 5 is retracted towards the lift truck 12 by actuating the push-pull assembly in the inward direction. The push-pull assembly 5 is configured to be controlled by an operator of the lift truck 12 using, for example, a hand controller.

Figure 2:
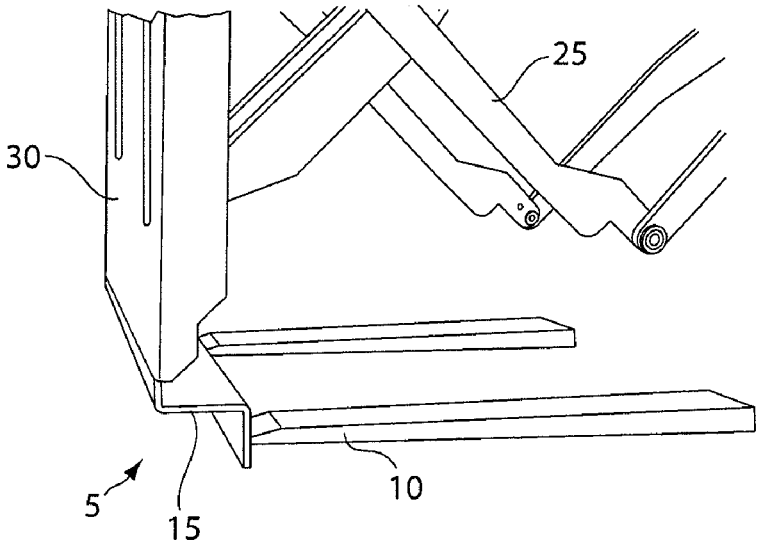
FIG. 2 is a diagram of the material handling apparatus shown in FIG. 1 with a push-pull assembly extended.
Figure 3:
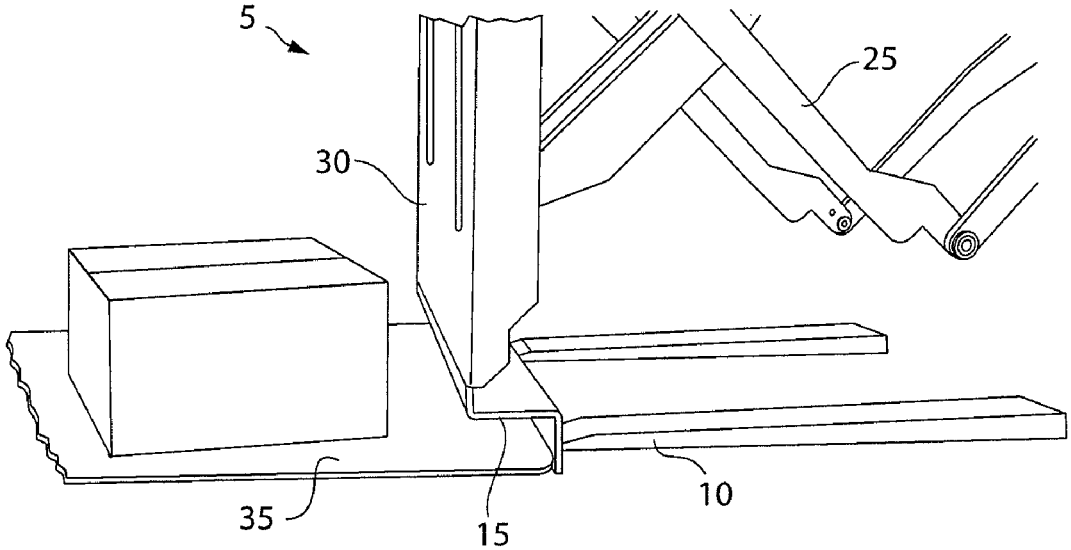
FIG. 3 is a diagram of the material handling apparatus shown in FIG. 1 with the push-pull assembly extended.
Figure 4:
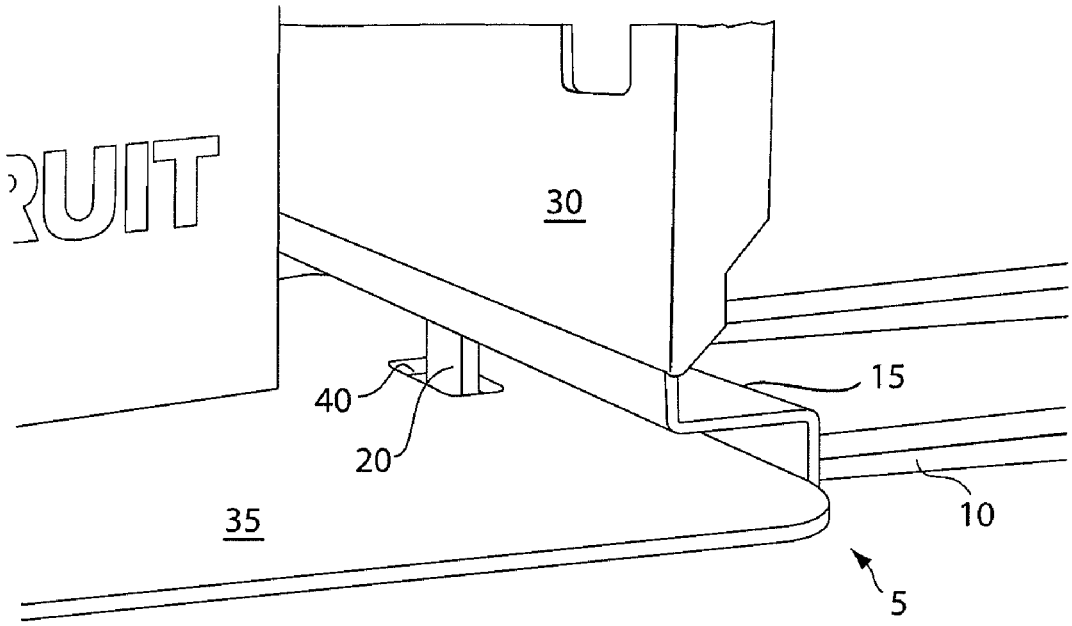
FIG. 4 is a diagram of the material handling apparatus shown in FIG. 1 with the push-pull assembly and a stud extended.
Figure 5:
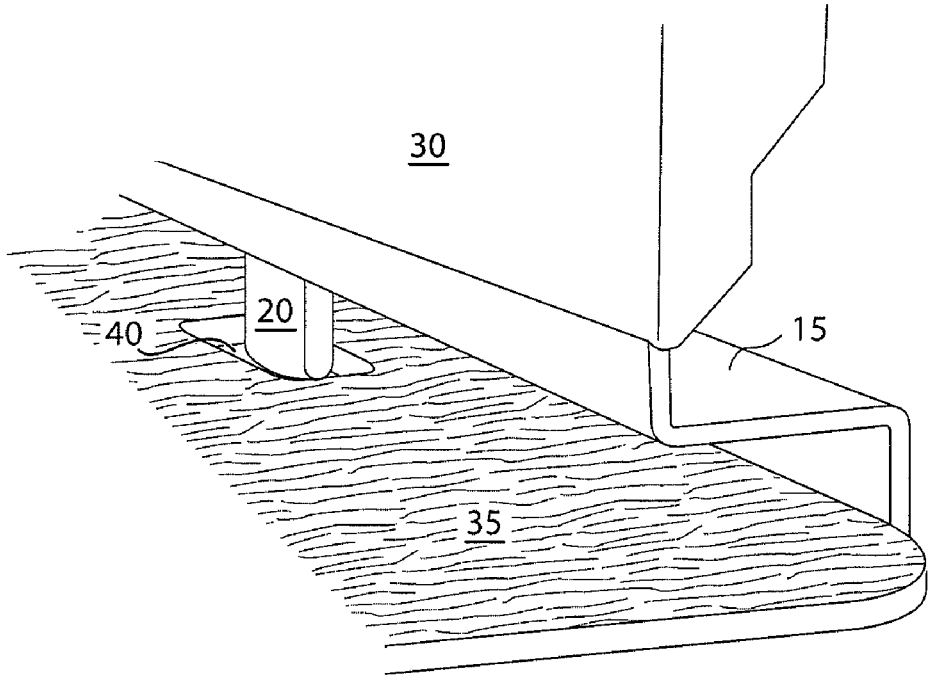
FIG. 5 is a diagram of the material handling apparatus shown in FIG. 1 with the stud extended.
Figure 6:
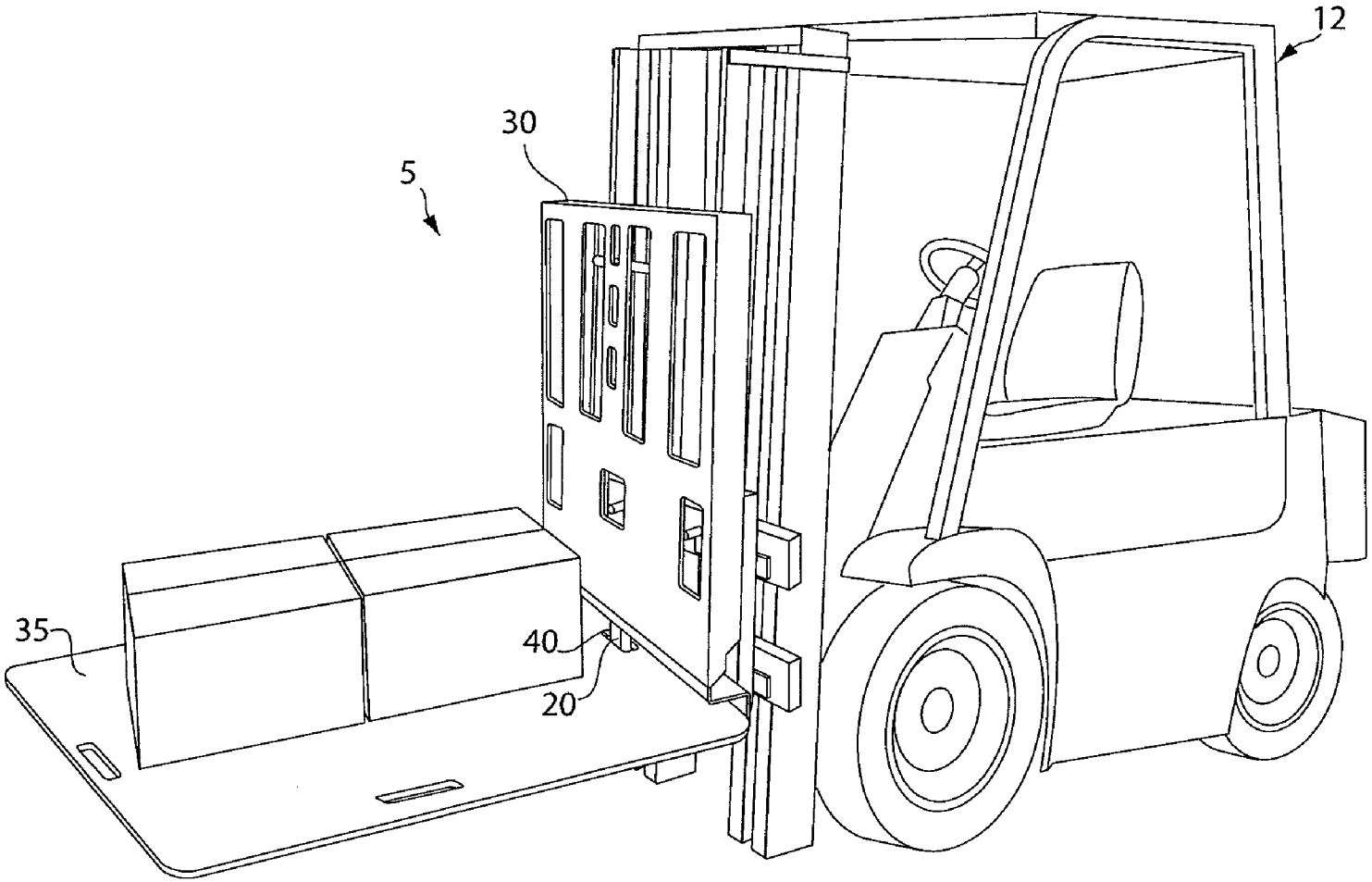
FIG. 6 is a diagram of the material handling apparatus shown in FIG. 1 with the push-pull assembly retracted.

The push-pull assembly 5 includes a stop 15, an extendable stud 20 (not visible in FIG. 1), a scissor portion 25, and a backrest 30. The push-pull assembly 5 is configured to be operable using hydraulic, pneumatic, electrical, and/or electromechanical power provided by the attached lift truck and/or can be self powered. The scissor portion 25 is, for example, a pantograph device. The backrest 30 can vary in size (e.g., a few inches tall to a few feet tall). The stop 15 and the stud 20 are supported by the push-pull assembly 5. The stop 15 is preferably about the same width as the backrest 30, although other configurations are possible (e.g., the stop 15 can be split into two sections). To retrieve a carrier board 35, the push-pull assembly 5 is preferably configured to extend at least about as far as the end of the forks 10 (e.g., as shown in FIGS. 2-3) and is configured to extend the stud 20 into and/or through an aperture 40 provided by the carrier board 35 to "attach" the carrier board 35 to the push-pull assembly 5 (e.g., as shown in FIGS. 4-5). The push-pull assembly 5 is configured to retract, with the stud 20 extended, to pull the attached carrier board 35 onto the support members 10 (e.g., as shown in FIG. 6). The system 1 is configured to securely grip the attached supported carrier board 35 such that the lift truck can move about without the attached supported carrier board 35 becoming separated from the system 1.

Figure 7:
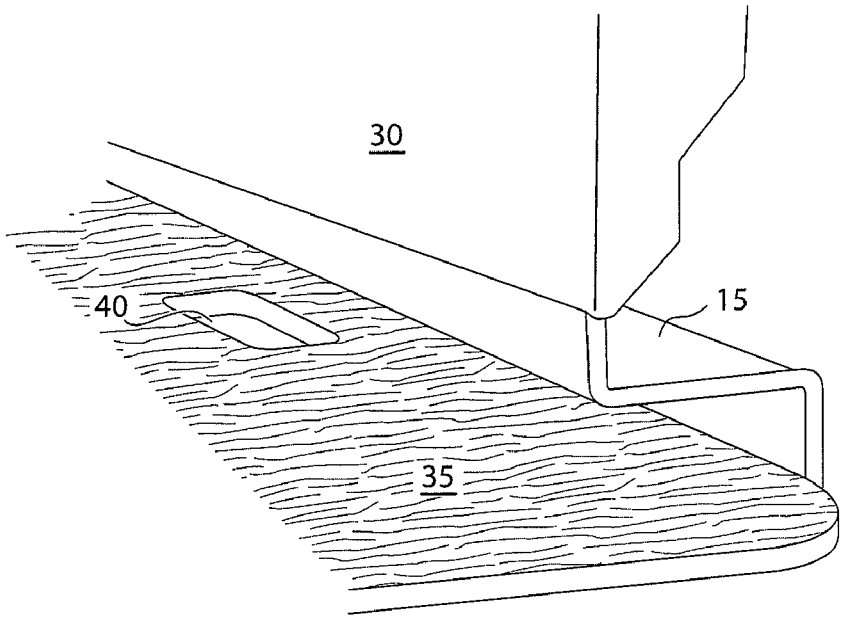
FIG. 7 is a diagram of the material handling apparatus shown in FIG. 1 with the stud retracted.
Figure 8:
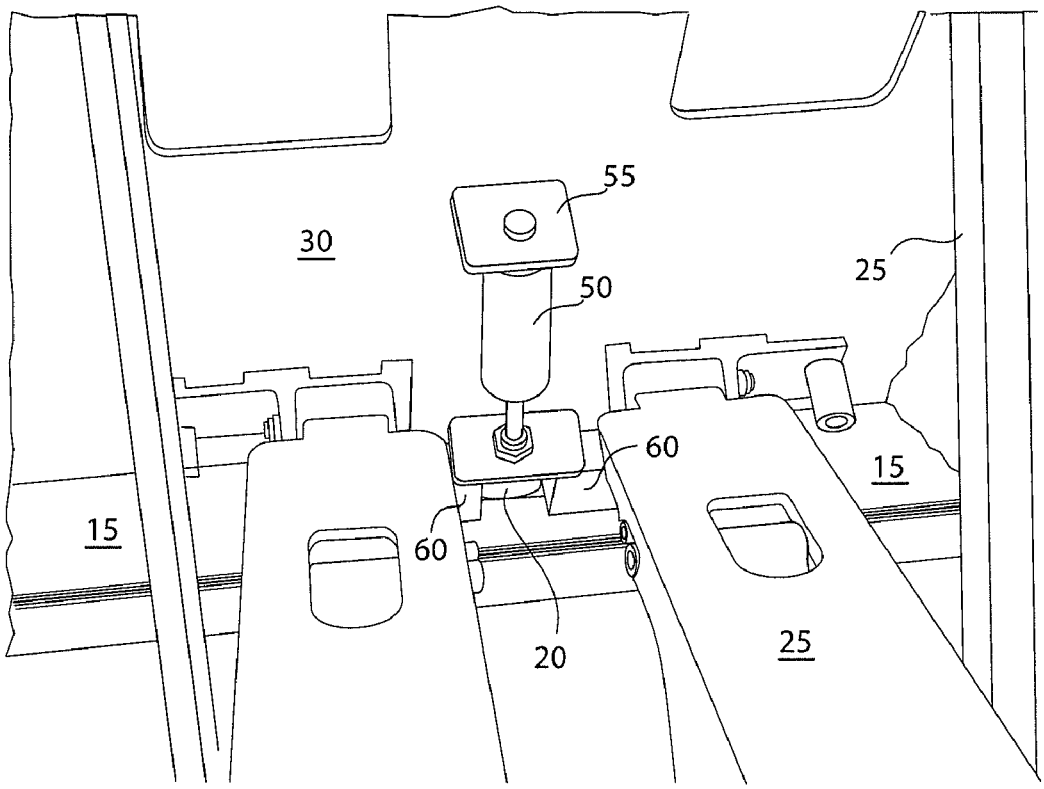
FIG. 8 is a diagram of the push-pull assembly shown in FIG. 1.
Figure 9:
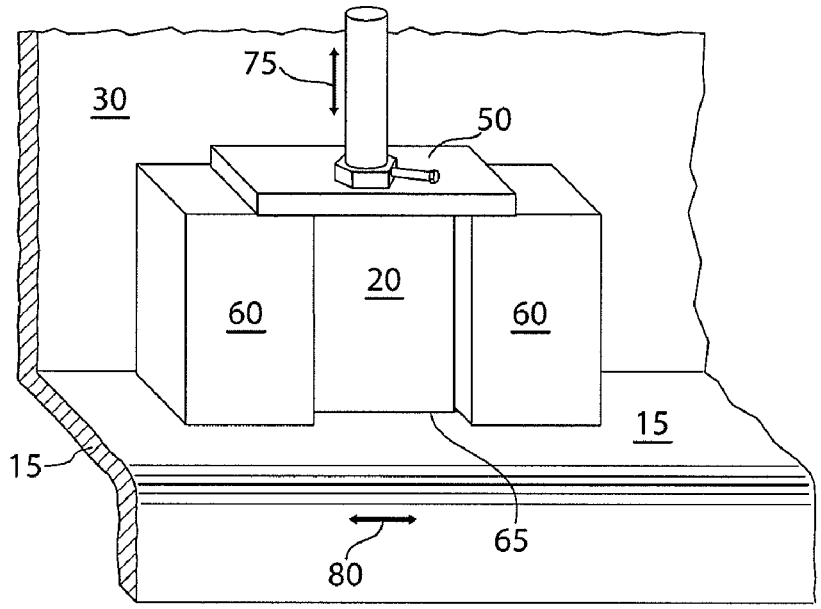
FIG. 9 is a diagram of the stud in an extended position.
Figure 10:
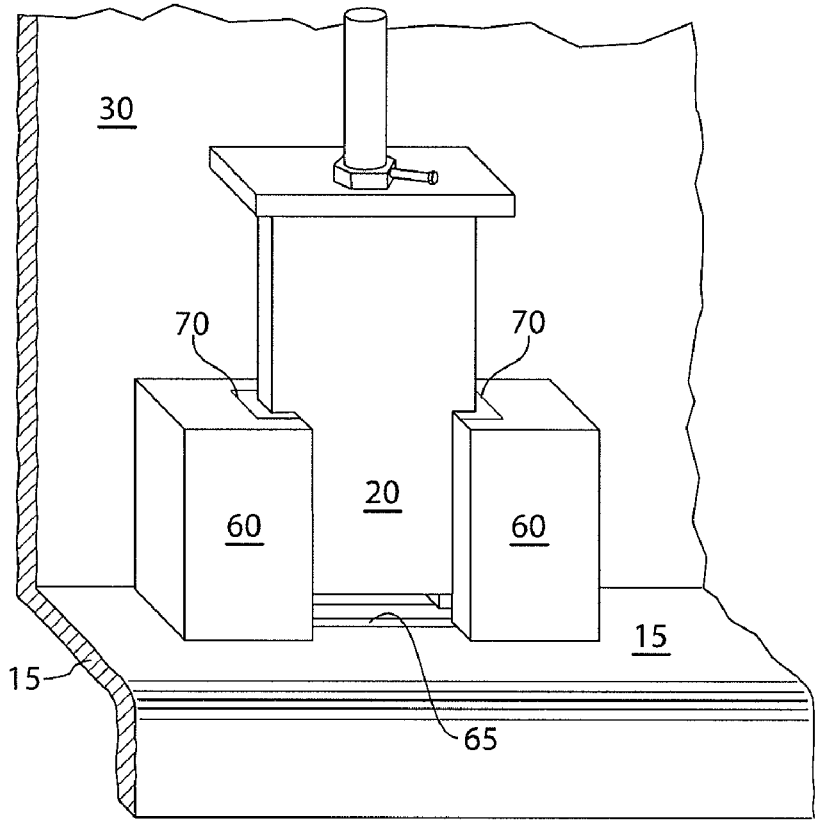
FIG. 10 is a diagram of the stud in a retracted position.
Figure 11:
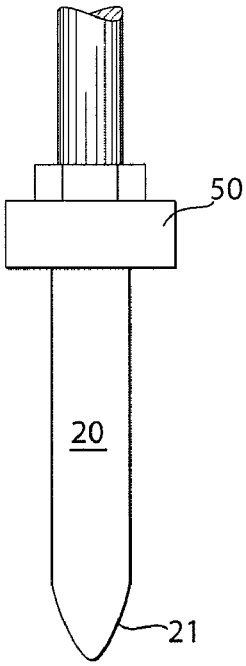
FIG. 11 is a diagram of the stud shown in FIG. 10.
Figure 12:
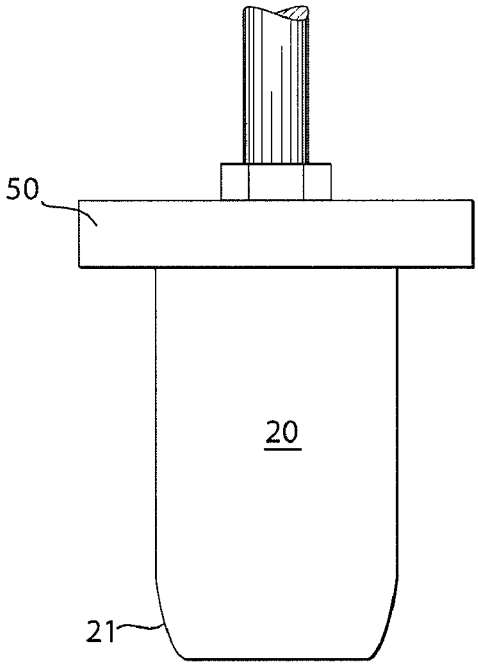
FIG. 12 is a diagram of the stud shown in FIG. 10.

The push-pull assembly 5 is also configured to unload a carrier board 35 that is supported by the forks 10. The push-pull assembly 5 is configured to (e.g., using the stop 15) push the carrier board 35 off of the forks 10 onto, for example, a racking system. Upon placing the carrier board 35 onto a racking system, the operator can disengage the stud 20 from the aperture 40 of the carrier board 35 (e.g., as shown in FIG. 7) and retract the push-pull assembly 5, leaving the carrier board 35 on the racking system. The stud 20, however, can be retracted at other times as well.

The push-pull assembly 5 is configured to be operated using several methods. The operation of the push-pull assembly 5 and the stud 20 can be controlled by respective hand and/or foot controls. For example, one three-way switch (e.g., extend, stop, and retract) can control the operation of the push-pull assembly 5, and another three-way switch can control the operation of the stud 20. Likewise, a single three-position can be used to control the operation of the push-pull assembly 5 and the stud 20 jointly. For example, the operator can extend the push-pull assembly 5 by moving the switch to the extend position. Once the push-pull assembly 5 is fully extended, the operator can maintain the switch in the extend position to extend the stud 20. Other control configurations are possible.

Referring to FIGS. 8-12, the stud 20 is disposed on the backrest 30 and is configured to actuate between retracted and extended positions using an actuator 50 that is coupled to a plate 55. The actuator 50 is preferably hydraulic, although other types of actuators can be used. The plate 55 is disposed on the backrest 30 and is configured to attach to the actuator 50. Guides 60 are disposed on the stop 15 and the backrest 30 and are configured to position the stud 20 relative to an aperture 65 in the stop 15. The aperture 15 is sized such that the stud 20 can pass therethrough when actuated by the actuator 50. The guides 60 include channels 70 that are sized to receive the peripheral edges of the stud 20 and are configured to align the stud 20 relative to the aperture 65. The actuator 50 and the guides 60 are configured such that when the actuator 50 actuates the stud 20 between the retracted and extended positions, the stud 20 moves in a substantially vertical direction (e.g., arrow 75) that is parallel to the backrest 30 (e.g., perpendicular relative to the direction of travel of the push-pull assembly 5).

The push-pull assembly 5 is configured to facilitate alignment of the stud 20 with a carrier board 35 which is to be handled by the system 1. The stud 20 is configured to be adjustable in multiple directions and is configured to compensate for a misaligned carrier board 35 relative to the stud 20. The stud 20 includes rounded portions 21 and is tapered to facilitate alignment and insertion of the stud 20 into the aperture 40. For example, the channels 70 can be "loose-fit" to the stud 20 (e.g. represented by the dashed lines in FIG. 10) such that as the stud 20 is extended towards the aperture 40 of the carrier board 35, the rounded portions 21 are configured to cause the stud 20 to self-align with the aperture 40.

Additional hydraulic actuators can also be used to align the stud 20 relative to the aperture 40 of the carrier board 35. For example, the guide blocks 60 can be coupled to hydraulic actuators such that the stud 20 can move in a direction perpendicular to the backing plate 30 (e.g., in the same direction as the direction of travel of the push-pull assembly 5). Furthermore, hydraulic actuators can also be configured to actuate the guide blocks 60 such the stud 20 can move in a direction parallel to the backing plate (e.g., side-to-side as shown by arrow 80). The additional actuators can be configured to be controlled by an operator of the lift truck 12 using a hand-control.

The push-pull assembly 5 is configured to be stowed (e.g., in the retracted position) such that the lift truck 12 can function normally (e.g., the push-pull assembly 5 can remain attached to the lift truck 12 while the lift truck 12 handles ordinary pallets). For example, a manufacturer could supply a pallet of goods that includes multiple levels of carrier boards (e.g., every tier of product on the pallet is on a separate carrier board). A single unit could unload the pallet of carrier boards from a truck, and place the carrier boards in the racking system without having to use a separate lift truck, or change lift truck attachments.

Figure 13:
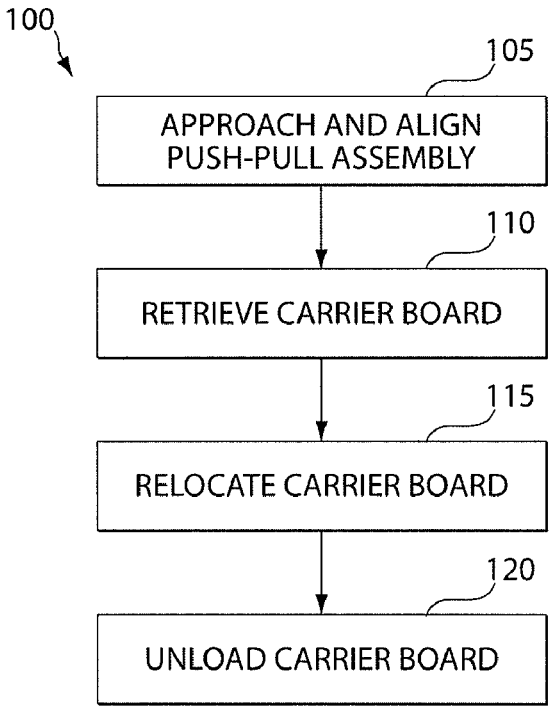
FIG. 13 is a diagram of a process for retrieving and unloading a carrier board.
Figure 14A:
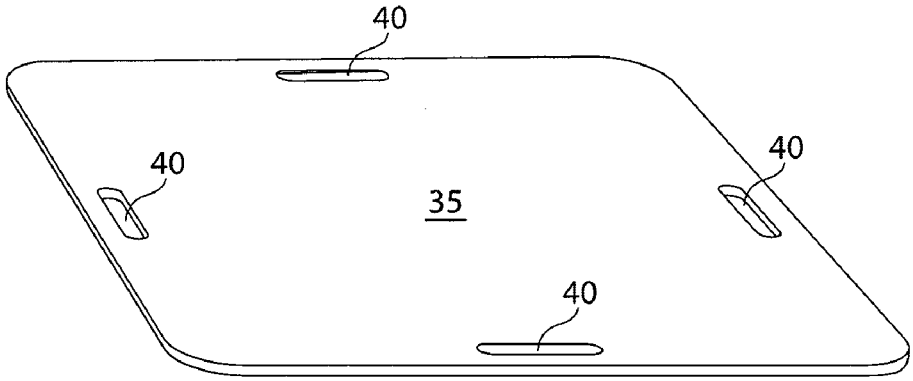
FIGS. 14A-14C are diagrams of a carrier board for use with the material handling apparatus shown in FIG. 1.
Figure 14B:
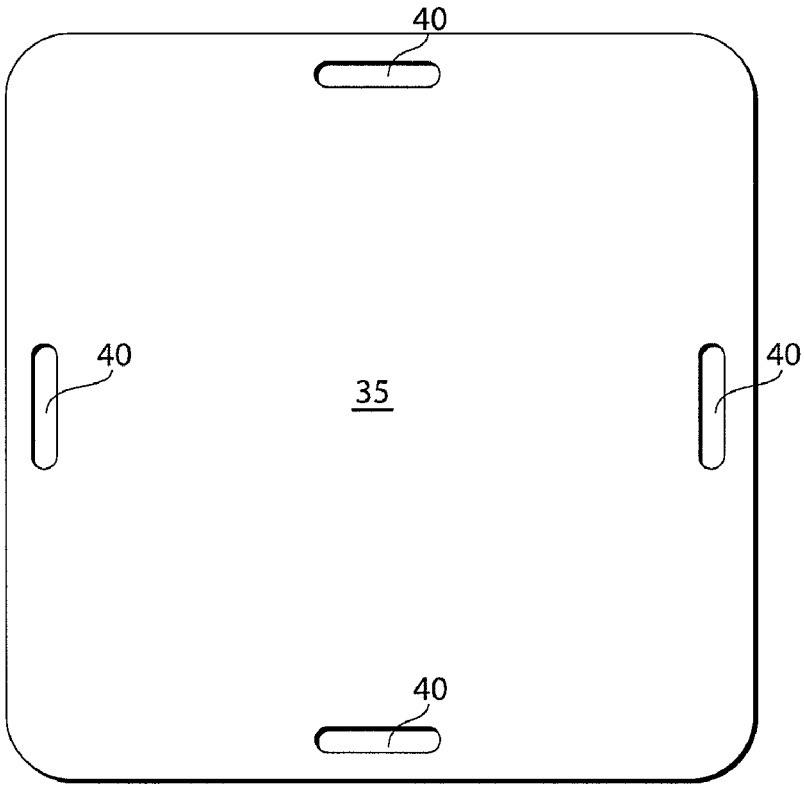
Figure 14C:
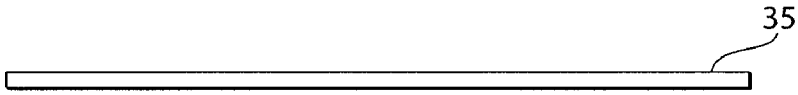

In operation, referring to FIG. 13, with further reference to FIGS. 1-12, a process 100 for retrieving and unloading a carrier board using the system 1 includes the stages shown. The process 100, however, is exemplary only and not limiting. The process 100 may be altered, e.g., by having stages added, removed, or rearranged. The process 100 is configured to be used with carrier boards such as the carrier board 35 shown in FIGS. 14A-14B, although other carrier boards can be used.

At stage 105, the lift truck 12 driven by an operator approaches a carrier board 35. The operator generally aligns the lift truck 12 with the carrier board 35. The carrier board 35 can be located in a racking system, or in a stack (e.g., a carrier board layer, a material layer, a carrier board layer, a material layer, etc.), although other configurations are possible. The remainder of the description pertaining to the process 100 assumes that the carrier board 35 is located in a racking system.

At stage 110, the operator retrieves the carrier board 35 from the racking system. Preferably, the operator adjusts the lift truck 12 such that the distal ends of the forks 10 are close (e.g., within a few inches) of the carrier board 35 and such that the top of the forks 10 are positioned slightly below the bottom of the carrier board 35. The operator extends the push-pull assembly 5 to at least about the end of the forks 10 such that one edge of the carrier board 35 is preferably in contact with the stop 15. The operator extends the stud 20 through the aperture 40 of the carrier board 35. The operator retracts the push-pull assembly 5 such that the carrier board 35 is pulled onto the forks 10 by the stud 20. Preferably, the operator retracts the push-pull assembly 5 such that the carrier board is fully supported by the forks 10.

At stage 115, the operator relocates the carrier board to a desired location using the lift truck 12. While relocating the carrier board 35 to the desired location, the stud 20 is preferably extended thereby reducing the likelihood that the carrier board 35 will become displaced from the forks 10.

At stage 120, the operator unloads the carrier board 35 from the lift truck. Preferably, the operator adjusts the lift truck 12 such that the distal ends of the forks 10 are slightly above the surface upon which the carrier board 35 will be supported on once unloaded from the lift truck 12. The operator extends the push-pull assembly 5 such that the stop 15 pushes the carrier board 35 away from the lift truck 12 into the desired location (e.g., in a bay of a racking system). The operator retracts the stud 20 from the aperture 40 of the carrier board 35 and retracts the push-pull assembly 5.

Other embodiments are within the scope and spirit of the invention. For example, due to the nature of software, functions described above can be implemented using software, hardware, firmware, hardwiring, or combinations of any of these. Features implementing functions may also be physically located at various positions, including being distributed such that portions of functions are implemented at different physical locations.

While "forks" 10 have been described herein, other configurations are possible. For example, the forks can be other support means capable of supporting the weight of a load placed thereupon (e.g., slip sheet forks or an extendable table).

While the push-pull assembly 5 is described herein as being attached to forklift truck 12, other configurations are possible. For example, the push-pull assembly 5 can be configured to attach to a lift truck such as an automated material handling system (e.g., a robotic material handling system).

Further, while the description above refers to the invention, the description may include more than one invention.

What is claimed is:

1. A material handling apparatus for use with a material carrier board including an aperture, the material handling apparatus being configured to couple to a lifting portion of a lift truck that includes forks, the material handling apparatus comprising:

a mount configured to be coupled to the lifting portion of the lift truck;

a backrest having a bottom edge and a front face;

a scissor structure coupled to the mount and to the backrest, the scissor structure being configured to operate between extended and retracted states, wherein when the scissor structure is operated from the retracted state to the extended state, the backrest is extended from a proximal end of the forks towards a distal end of the forks;

a fixed stop plate including horizontal and vertical planar portions, the stop plate being attached to the bottom edge of the backrest, the stop plate being attached to the backrest such that the horizontal planar portion is substantially perpendicular to the front face of the backrest, the vertical planar portion is substantially parallel to and offset from the front face of the backrest, the horizontal planar portion of the stop plate forming an aperture, the vertical planar portion being configured to push an outside edge of the material carrier board;

a first actuator coupled to the mount and the scissor structure being configured to actuate the scissor structure between the extended and retracted states;

a second actuator coupled to the backrest;

a stud coupled to the second actuator and configured to operate between extended and retracted states along an axis that is substantially parallel to the front face of the backrest, the stud being configured to extend through the aperture formed in the stop plate and through the aperture formed in the carrier board when the stud is actuated from the retracted to the extended state, wherein the material handling apparatus is configured to pull the carrier board onto the forks by, when the stud is in the extended state, actuating the scissor portion from an extended state to a retracted state.

2. The apparatus of claim 1 wherein the horizontal and vertical planar portions are configured in an L-shape.

3. The apparatus of claim 1 wherein the stud includes a tapered portion that is positioned on a distal end of the stud, wherein the tapered portion is configured to aid alignment of the stud and the aperture in the carrier board.

4. The apparatus of claim 1 wherein the actuation of the scissor portion is controlled by a three-way control.

5. The apparatus of claim 1 wherein the actuation of the stud is controlled by a three-way control.

6. The apparatus of claim 1 wherein the actuation of the scissor portion and the stud are controlled by a single three-way control.

7. The apparatus of claim 1 further comprising a plurality of guide blocks coupled to the stop plate and configured to align the stud with the aperture formed in the horizontal portion of the stop plate.

* * * * *